US008798823B2

(12) United States Patent
Sakaguchi et al.

(10) Patent No.: US 8,798,823 B2
(45) Date of Patent: Aug. 5, 2014

(54) ELECTRONIC CONTROL APPARATUS FOR DRIVING A BOAT

(75) Inventors: Ryo Sakaguchi, Chiyoda-ku (JP); Hideki Umemoto, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 828 days.

(21) Appl. No.: 11/970,015

(22) Filed: Jan. 7, 2008

(65) Prior Publication Data

US 2009/0011665 A1 Jan. 8, 2009

(30) Foreign Application Priority Data

Jul. 6, 2007 (JP) ..... 2007-178327

(51) Int. Cl.

| | |
|---|---|
| ***B60L 3/00*** | (2006.01) |
| ***B60L 15/00*** | (2006.01) |
| ***G05D 1/00*** | (2006.01) |
| ***G05D 3/00*** | (2006.01) |
| ***G06F 7/00*** | (2006.01) |
| ***G06F 17/00*** | (2006.01) |
| ***B63H 21/22*** | (2006.01) |
| ***B63H 23/00*** | (2006.01) |

(52) U.S. Cl.

USPC ..... 701/21; 440/1

(58) Field of Classification Search

USPC ..... 701/21; 440/1

See application file for complete search history.

(56) References Cited

U.S. PATENT DOCUMENTS

| | | | | |
|---|---|---|---|---|
| 2002/0127925 | A1* | 9/2002 | Burg | 440/38 |
| 2002/0127926 | A1* | 9/2002 | Michel et al. | 440/38 |
| 2003/0109184 | A1* | 6/2003 | Kanno | 440/1 |
| 2003/0145825 | A1* | 8/2003 | Janic et al. | 123/339.19 |
| 2005/0164569 | A1* | 7/2005 | Kaji et al. | 440/1 |

FOREIGN PATENT DOCUMENTS

| | | | |
|---|---|---|---|
| JP | 2000-064871 | A | 2/2000 |
| JP | 2000108995 | A | 4/2000 |
| JP | 2004-052696 | A | 2/2004 |
| JP | 2004-142538 | A | 5/2004 |
| JP | 2008-201213 | A | 9/2008 |

OTHER PUBLICATIONS

Japanese Office Action dated Sep. 29, 2009.

* cited by examiner

*Primary Examiner* — Imran Mustafa

(74) *Attorney, Agent, or Firm* — Sughrue Mion, PLLC

(57) ABSTRACT

An electronic control apparatus for driving a boat capable of safely and positively steering the boat to move forward and backward, including: a steering mechanism; a shift actuator for switching neutral, forward, backward; a throttle actuator for driving a throttle valve; and an electronic control unit connected to the steering mechanism, the shift actuator and the throttle actuator, for calculating a movement command value and an output command value for controlling the shift actuator and the throttle actuator, respectively, based on a steering position signal from the steering mechanism, and for controlling the shift actuator and the throttle actuator according to the movement command value, the output command value, feedback signals indicating control states, the electronic control section restrains the output command value until a shift operation of the shift actuator is completed, when the movement command value has been generated for shifting the shift actuator to forward or backward.

15 Claims, 11 Drawing Sheets

ELECTRONIC CONTROL APPARATUS FOR DRIVING A BOAT

BACKGROUND OF THE INVENTION

1. Field of the Invention

The present invention relates to an electronic control apparatus for driving a boat, which exercises control over driving of a boat, in particular, an electronic control apparatus for driving a boat provided with no mechanical cable or another mechanical links.

2. Description of the Related Art

Conventional examples of an electronic control apparatus for driving a boat of the above-mentioned type include an electronic control system for a boat having no mechanical cable or another mechanical links between a steering position and a propulsion system of the boat, in which the boat is provided with the propulsion system and a steering station including a throttle, a shift, and cruise control elements located at some distance from the propulsion system, the throttle, the shift, and the cruise control elements of the steering station generate electrical signals which are transmitted to an electronic control apparatus in the propulsion system, the electronic control apparatus controls fuel injection and ignition of fuel for the propulsion system and also gives signals to a throttle and a transmission in response to an operator's manipulation of the throttle, the shift, or the cruise control elements, and there is no mechanical links or cables between the throttle, the shift, and the cruise control elements and the propulsion system (see, for example, JP 2000-108995 A).

According to the electronic control apparatus of this type, in order to steer the boat to a forward state or a backward state from a neutral state, a throttle driving part relating to an output of the boat and a shift driving part relating to a moving direction such as forward, neutral, or backward, of the boat, are driven independently of each other as independent driving parts, based on a command value transmitted from the steering station.

In a case of executing steering control for a boat, if a larger load is applied to a screw propeller of a propulsion system when the boat is steered from a neutral state to a forward state or a backward state, it takes longer time to switch the shift position from the neutral state to the forward state or the backward state. In a case where a command for driving the throttle driving part in an output increase direction is given to the throttle driving part from the steering station during when the shift position is being switched, the throttle driving part is driven in the output increase direction without waiting the shift position to reach the movement command value (shift switching completion position), which increases a rotational speed of the engine, leading to problems that a greater shock is given when switching the shift, the shift mechanism of the transmission is damaged due to a great force applied to a mechanical mechanism of the shift because the shift is switched from the neutral position to the forward position or the backward position under a state where the rotational speed of the engine is high, or the shift cannot be changed due to an increase of a torque for switching the shift.

The above-mentioned problems are often caused when the steering lever is suddenly moved from the neutral state to the forward state or the backward state.

In order to solve the above-mentioned problems, there may be provided a portion (so-called play portion) between the throttle (output) command value and the shift (movement) command value calculated from the position of the steering lever, the portion not being driven by the throttle (output) command value and by the shift (movement) command value, and the play portion may absorb time necessary for the switching of the shift. In this case, however, the arithmetic resolution powers of both or one of the output command value and the movement command value calculated from the position of the steering lever are increased, leading to a problem that it is impossible to steer the boat in a meticulous manner.

SUMMARY OF THE INVENTION

The present invention has been made to solve the above-mentioned problems, and it is an object of the invention to provide an electronic control apparatus for driving a boat, which is capable of positively switching shift positions for moving the boat forward and backward, without damaging a shift mechanism of the transmission or reducing the resolution powers of the movement (shift) command value and the output (throttle) command value calculated from the steering position of the steering lever.

The present invention provides an electronic control apparatus for driving a boat including: a steering mechanism operated by an operator; a shift actuator for switching a transmission of an engine of a boat among neutral, forward, and backward; a throttle actuator for driving a throttle valve to regulate an engine output; electronic control section connected to each of the steering mechanism, the shift actuator, and the throttle actuator, for calculating a movement command value and an output command value for controlling the shift actuator and the throttle actuator, respectively, based on a steering position signal from the steering mechanism, and for controlling the shift actuator and the throttle actuator according to the movement command value and a feedback signal indicating a control state of the shift actuator, and the output command value and a feedback signal indicating a control state of the throttle actuator, respectively, in which the electronic control section restrains or curbs the output command value until a shift operation of the shift actuator is completed, in a case where the movement command value has been generated for shifting the shift actuator to one of forward and backward.

According the electronic control apparatus for driving a boat of the present invention, it is possible to suppress a shock from being generated when switching the shift, to prevent a force from being suddenly applied to the shift mechanism of the transmission, and to prevent the resolution powers of the movement (shift) command value and the output (throttle) command value for controlling the shift actuator and the throttle actuator, respectively, from being reduced.

DETAILED DESCRIPTION OF THE PREFERRED EMBODIMENT

Embodiment 1

Figure 1:
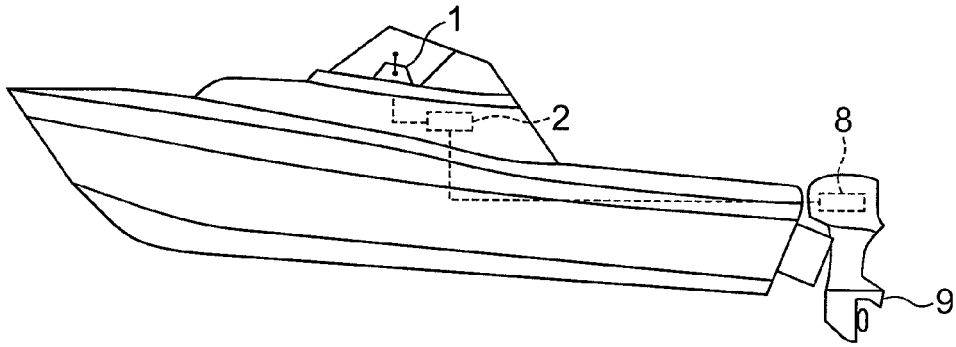
FIG. 1 is a schematic structural diagram of a boat with an outboard motor provided with an electronic control device for driving a boat according to the present invention.

FIG. 1 is a schematic structural diagram of a boat with an outboard motor provided with an electronic control apparatus for driving a boat according to the present invention. A helm position of the boat is installed with a steering lever 1 for steering the boat by an operator, a steering wheel (not shown) for deciding a steering direction, switches (not shown) such as a starting switch and a stopping switch for starting and stopping an engine 8 of an outboard motor 9, and lamps and an indicator (both not shown) such as an LED for displaying statuses of the engine 8 as well as the outboard motor 9, to the operator. An operation command input through the operation lever 1 is detected in a steering request detecting device 2. According to the operation command thus detected, the engine 8 of the outboard motor 9 is controlled.

Figure 2:
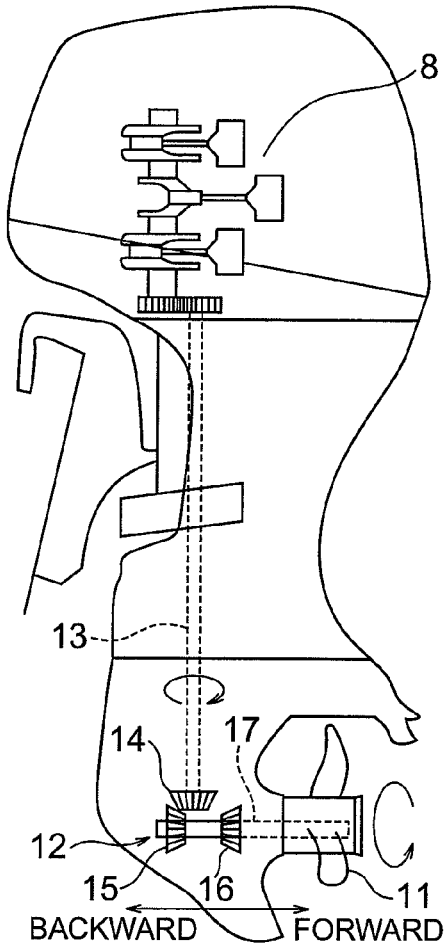
FIG. 2 is a schematic structural diagram of the outboard motor of FIG. 1.

FIG. 2 is a schematic structural diagram of the outboard motor 9 of FIG. 1, and FIGS. 3A to 3C are diagrams each showing a shift position of the steering lever 1 of FIG. 1. Hereinafter, the same reference numerals are used to denote similar or corresponding components in the drawings. The drive torque of the engine 8 is conveyed to a screw propeller 11 through a drive shaft 13, and a drive gear 14, a forward gear 15 or a backward gear 16, and a screw shaft 17 of a transmission 12.

Figure 3A:
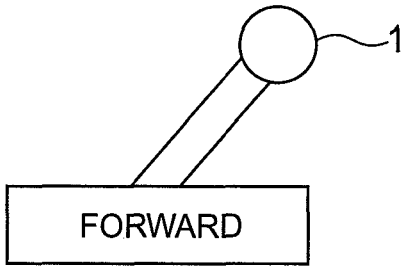
FIGS. 3A to 3C are diagrams each showing a shift position of a steering lever of FIG. 1.
Figure 3B:
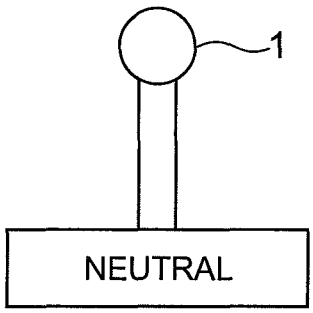
Figure 3C:
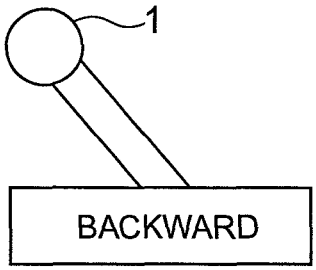

For example, when the steering lever 1 is positioned data forward position as shown in FIG. 3A, the screw shaft 17 of the transmission 12 is shifted to a forward position of FIG. 2, that is, to the right of the drawing. When the screw shaft 17 is shifted to the forward position, the drive gear 14 and the forward gear 15 are engaged with each other to convey the drive torque to the screw shaft 17, to thereby rotate the screw propeller 11. When the steering lever 1 is positioned at a neutral position as shown in FIG. 3B, the screw shaft 17 is shifted to a neutral position at which the drive gear 14 does not engage with either the forward gear 15 or the backward gear 16 therebetween. When the screw shaft 17 is shifted to the neutral position, the drive torque is not conveyed to the screw shaft 17 and therefore the screw propeller 11 is not rotated. When the steering lever 1 is positioned at a backward position as shown in FIG. 3C, the screw shaft 17 is shifted to a backward position of FIG. 2, that is, to the left of the drawing. When the screw shaft 17 is shifted to the backward position, the drive gear 14 and the backward gear 16 are engaged with each other to convey the drive torque to the screw shaft 17, to thereby rotate the screw propeller 11 in a reverse direction. In reality, the driving gear 14 is moved from a neutral state to be engaged with a clutch (not shown), thereby being switched between a forward side and a backward side.

Figure 4:
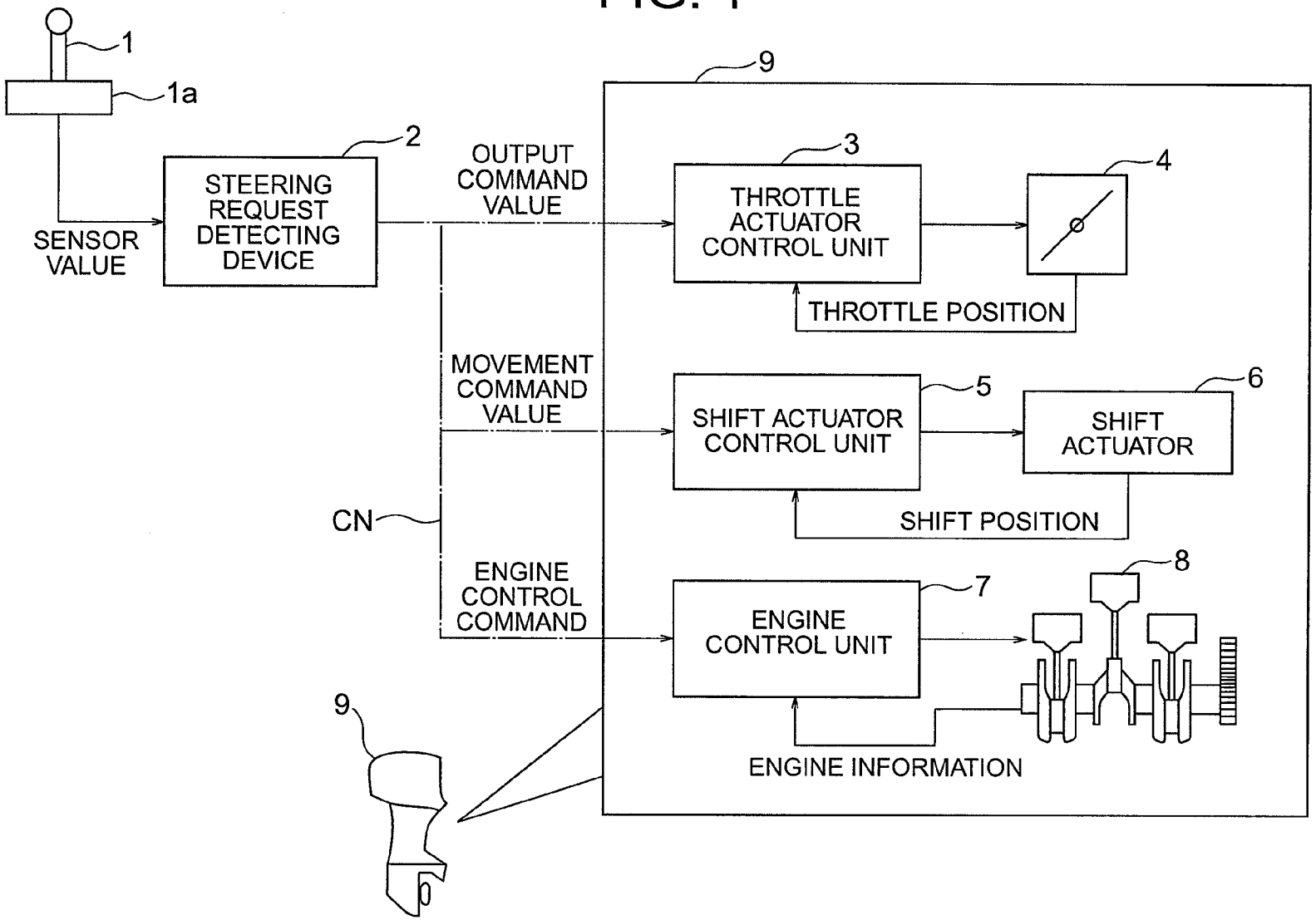
FIG. 4 is a block diagram showing a structure of the electronic control apparatus for driving a boat according to an embodiment of the present invention.

FIG. 4 is a block diagram showing a structure of the electronic control apparatus for driving a boat according to an embodiment of the present invention. The steering lever 1 is provided with an operation angle sensor 1*a* for detecting, for example, an angular position as an operation position of the steering lever 1. The operation angle sensor 1*a* outputs a sensor value signal (operation position signal) indicating the angular position thus detected. The steering lever 1 and the operation angel sensor 1*a* form a steering mechanism. The sensor value signal is input to the steering request detecting device 2.

The steering request detecting device 2 calculates an output command value, a movement command value, and an engine control command, according to the sensor value signal from the operation angle sensor 1*a*, and transmits the output command value, the movement command value, and the engine control command to the outboard motor 9 side. The output command value is a command value for controlling a throttle aperture, that is, a throttle position of a throttle actuator 4 which drives a throttle valve for controlling an output of the engine 8 by regulating an air amount to be supplied to the engine 8 on the outboard motor 9 side. The movement command value is a command value for controlling a shift position of a shift actuator 6 which shifts the screw shaft 17 of the transmission 12 to the forward position, the neutral position, or the backward position. The engine control command is a command for controlling a status of the engine 8 except the status of the throttle valve. The steering request detecting device 2 also detects, controls, and communicates information relating to steering requests input through devices other than the steering lever 1 equipped with the operation angle sensor 1*a* in the helm position such as the steering wheel and the switches, and information relating to contents displayed by the lamps and the indicator.

On the other hand, the outboard motor 9 is provided with the throttle actuator 4, the shift actuator 6, and the engine 8 connected to a throttle actuator control unit 3, a shift actuator control unit 5, and an engine control unit 7, respectively.

The throttle actuator control unit 3 controls a throttle position of the throttle actuator 4 based on an output command value signal from the steering request detecting device 2 and a current throttle position signal received from the throttle actuator 4 as a feedback signal. The shift actuator control unit 5 controls a shift position of the shift actuator 6 based on a movement command value signal from the steering request detecting device 2 and a current shift position signal received from the shift actuator 6 as a feedback signal. The engine control unit 7 controls a control state of the engine 8 based on an engine control command signal from the steering request detecting device 2 and a current engine status signal received from the engine 8 as a feedback signal. Accordingly, it is possible to detect an aperture of the throttle valve, a position of the shift mechanism, and the like, to thereby execute drive control with reference to the commands.

Then, the throttle actuator control unit 3, the shift actuator control unit 5, and the engine control unit 7 on the outboard motor 9 side, and the steering request detecting device 2 as a control unit for a steering mechanism on the boat body side are communicably connected to one another through a communications section including an on-vehicle control area network (CAN) system. The control units each have a communications function and connected to one another through a communications network CN as the communications section. In this case, each of the control units transmits information input from a sensor, a switch, an actuator and the like, which are provided on the periphery of the control unit and related to the control unit, as communication information to the other control units, to thereby share the information.

The steering request detecting device 2, the throttle actuator control unit 3, the shift actuator control unit 5, the engine control unit 7, and the communications network CN each form an electronic control section.

Figure 5:
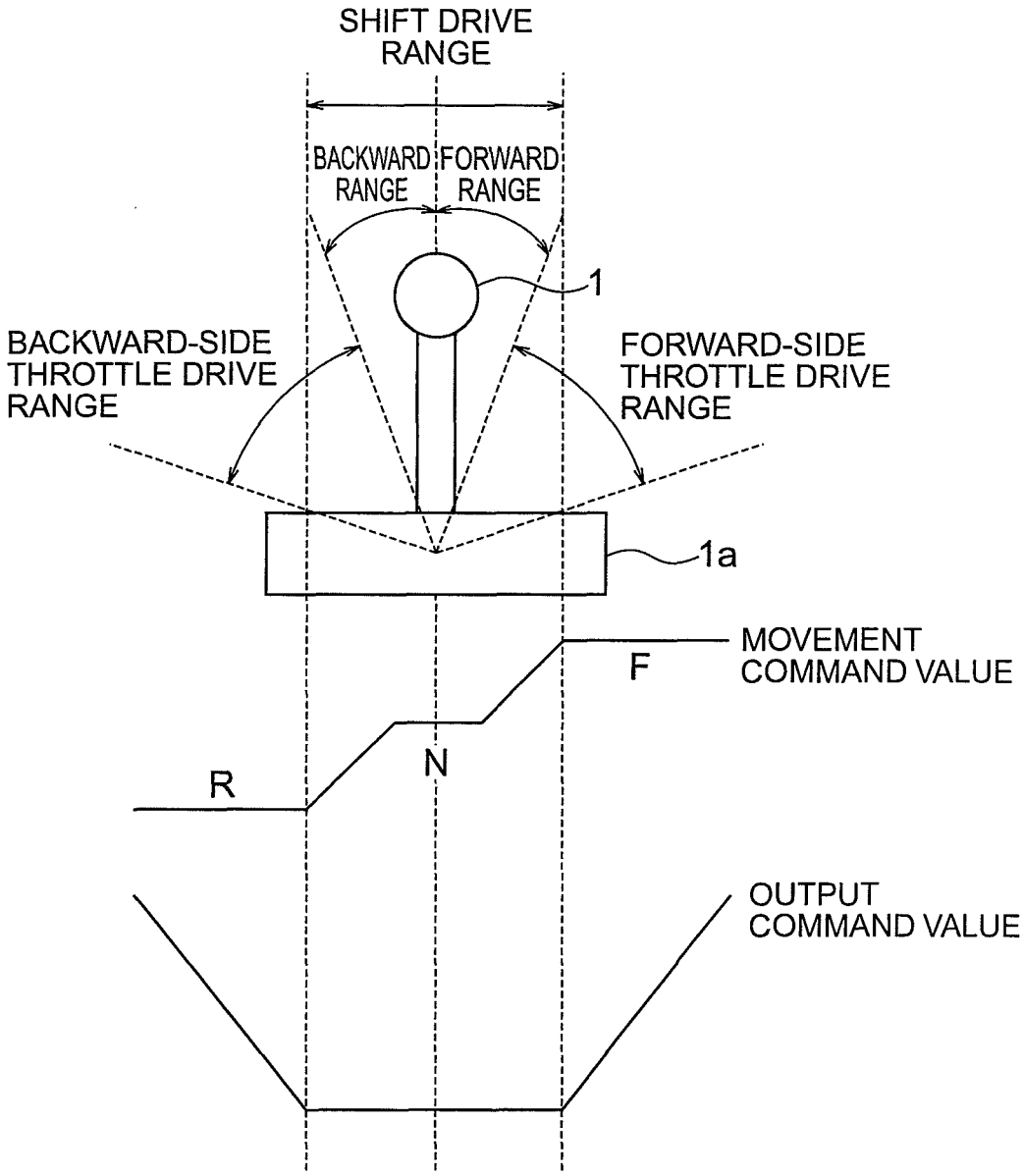
FIG. 5 is a diagram illustrating a relation between a steering angle (position) of the steering lever and a movement command value and an output command value transmitted from a steering request detecting device according to the present invention.

FIG. 5 is a diagram illustrating a relation between a steering angle (position) of the steering lever 1 and the movement command value and the output command value transmitted from the steering request detecting device 2 according to the present invention. When the operation angle of the steering lever 1 falls in a forward range or a backward range of a shift drive range, the movement command value increases or decreases from one of the outer ends of a neutral position N in proportion to the increase of the operation angle, to thereby reach, at the outer end of the forward range or the backward range, a value F indicating a position at which forward shifting completes or a value R indicating a position at which backward shifting completes. The output command value increases in a forward-side throttle drive range and a backward-side throttle drive range on both sides of the shift drive range, in proportion to the increase of the operation angle.

Figure 6:
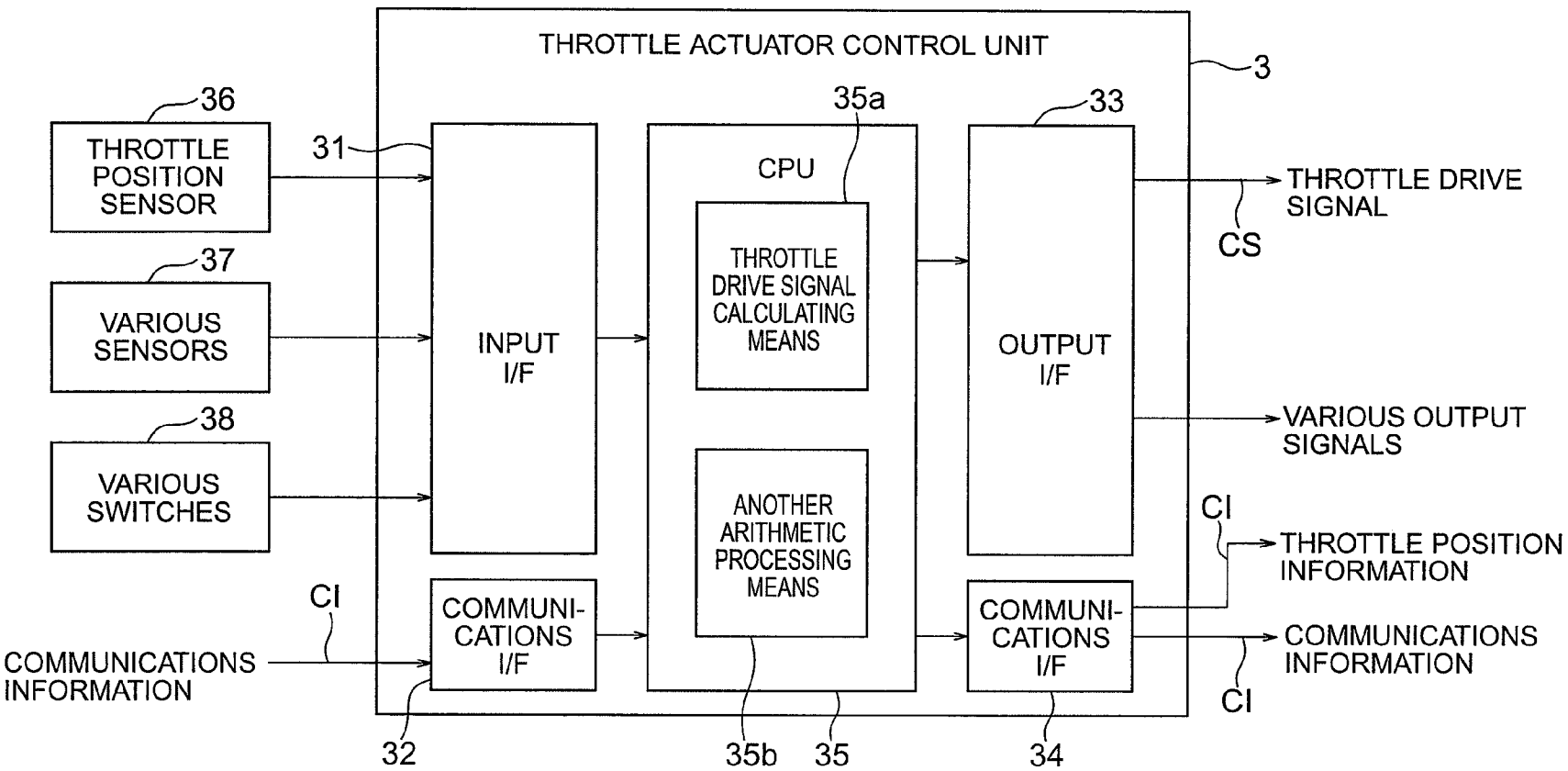
FIG. 6 is a diagram showing an example of a structure of a throttle actuator control unit according to the present invention.
Figure 7:
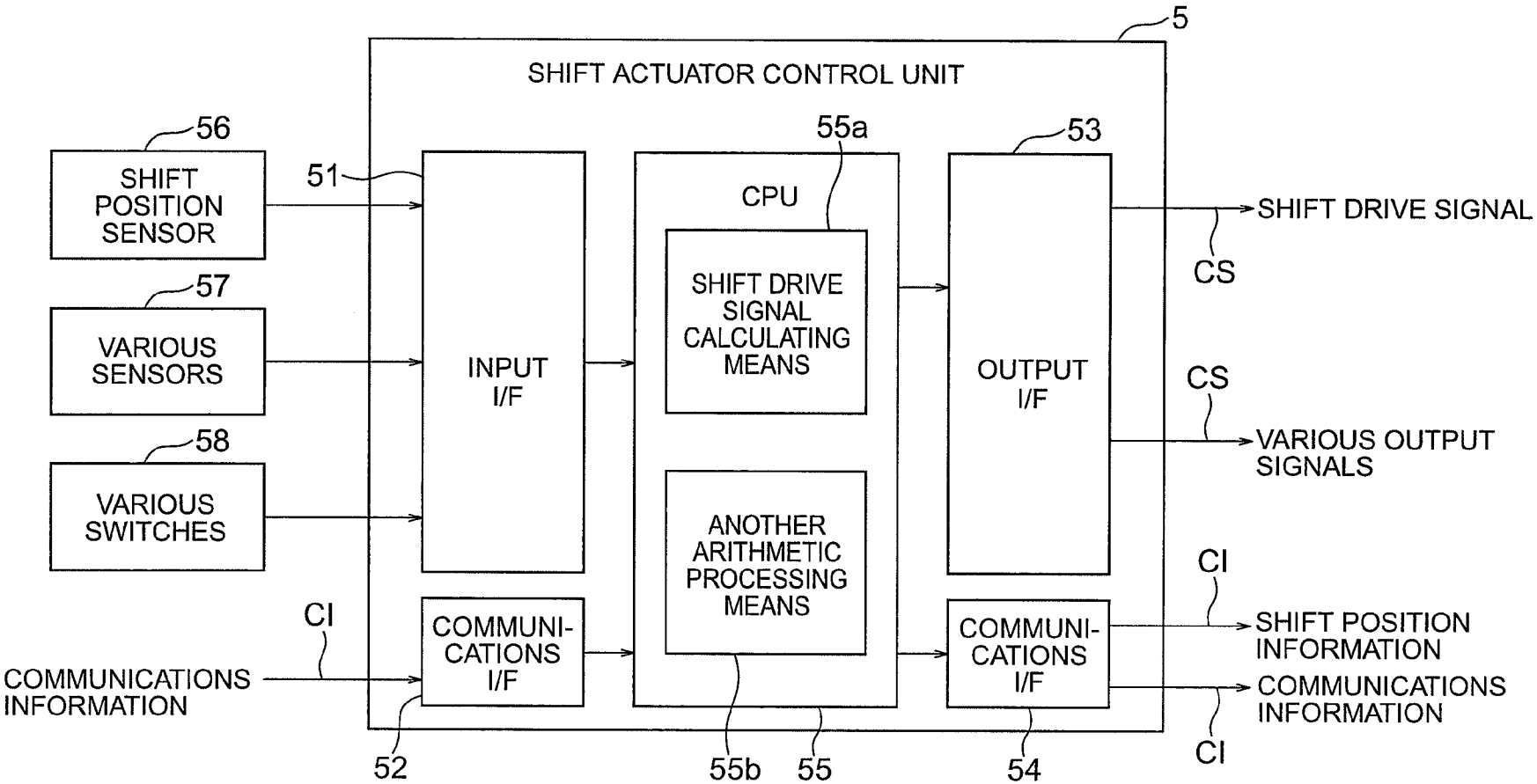
FIG. 7 is a diagram showing an example of a structure of a shift actuator control unit according to the present invention.
Figure 8:
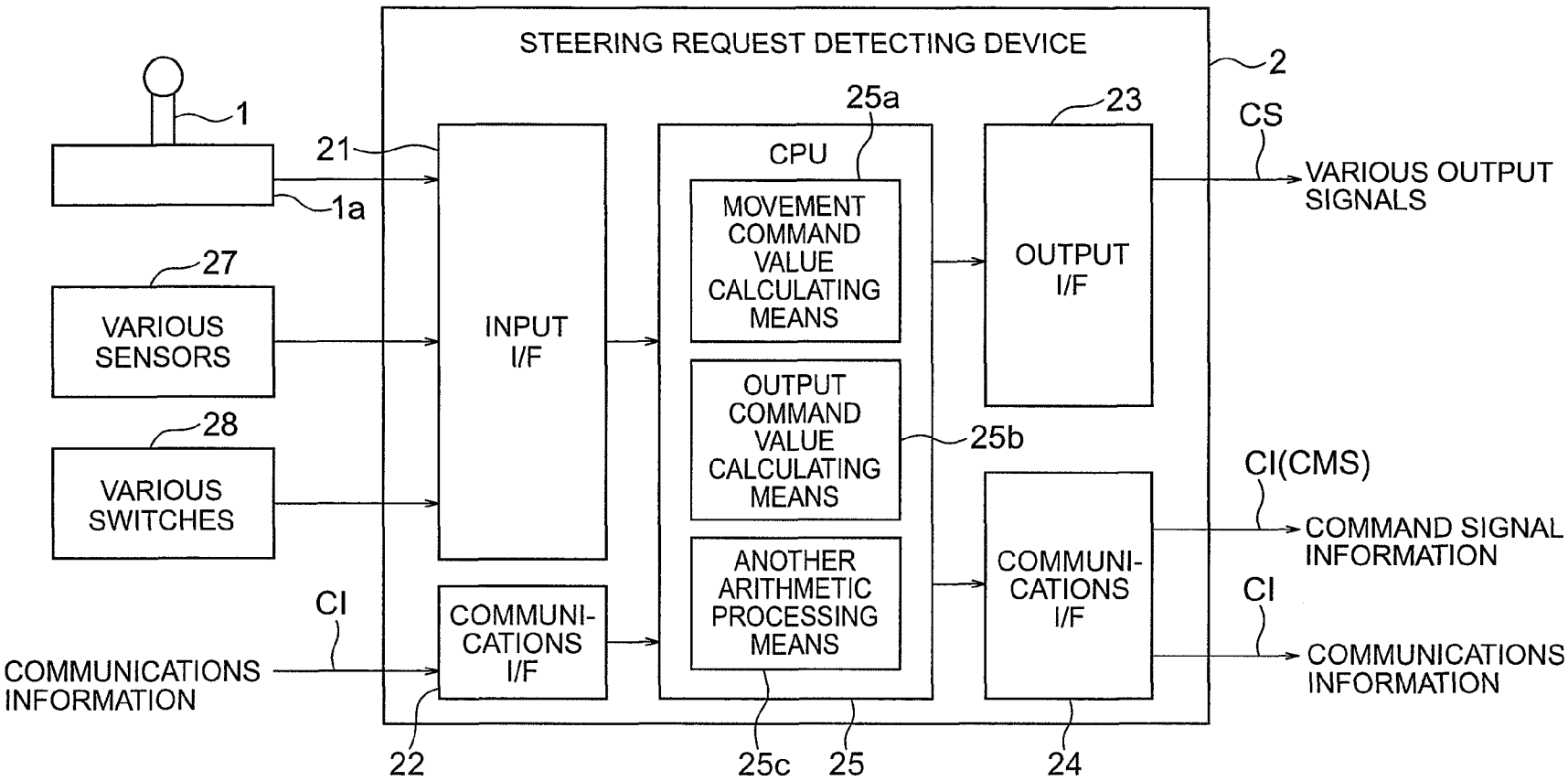
FIG. 8 is a diagram showing an example of a structure of the steering request detecting device according to the present invention.

FIGS. 6, 7, and 8 each show an example of a structure of the throttle actuator control unit 3, the shift actuator control unit 5, and steering request detecting device 2, each of which is structured as a control unit having a communications function for communicating in the on-vehicle CAN system and has a structure basically similar to one another.

In the throttle actuator control unit 3 of FIG. 6, a throttle position signal (feedback signal) indicating a current position of the throttle, which are output from a throttle position sensor 36 of the throttle valve (not shown), and detection signals output from various sensors 37 and various switches (SW) 38 which are related to the throttle actuator 4 and provided on the periphery thereof, are input through an input interface (hereinafter, referred to as I/F) 31.

A communications I/F 32 receives communications information CI transmitted from another control unit through the communications network CN.

A CPU 35 includes an arithmetic processing unit for performing a predetermined arithmetic operation according to the signals and the information obtained through the input I/F 31 and the communications I/F 32, and outputting the result of the arithmetic operation. The CPU 35 includes a throttle drive signal calculating section 35*a* and another arithmetic processing section 35*b* for performing another arithmetic processing including collection processing of detection signals from various sensors and transmission/reception processing of communications information.

The output I/F 33 outputs a throttle drive signal which is a control signal CS obtained as a result of the arithmetic processing in the CPU 35 and other various output signals, to the throttle actuator 4 and peripheral equipment.

The communications I/F 34 transmits the communications information CI including throttle position information to another control unit through the communications network CN.

In the shift actuator control unit 5 of FIG. 7, a shift position signal (feedback signal) indicating a current position of the shift, which are output from a shift position sensor 56 of the shift mechanism (not shown) of the screw shaft 17 of the transmission 12, and detection signals output from various sensors 57 and various switches SWs 58 which are related to the shift actuator 6 and provided on the periphery thereof, are input through an input I/F 51.

A communications I/F 52 receives the communications information CI transmitted from another control unit through the communications network CN.

A CPU 55 includes an arithmetic processing unit for performing a predetermined arithmetic operation according to the signals and the information obtained through the input I/F 51 and the communications I/F 52, and outputting the result of the arithmetic operation. The CPU 55 includes a shift drive signal calculating section 55*a* and another arithmetic processing section 55*b* for performing another arithmetic processing including collection processing of detection signals from various sensors and transmission/reception processing of communications information.

The output I/F 53 outputs a shift drive signal which is a control signal CS obtained as a result of the arithmetic processing in the CPU 55 and other various output signals, to the shift actuator 6 and peripheral equipment.

The communications I/F 54 transmits the communications information CI including shift position information to another control unit through the communications network CN.

In the steering request detecting device 2 of FIG. 8, a sensor value signal (feedback signal) indicating a current operation angle of the steering lever 1, which is output from an operation angle sensor la, and detection signals output from various sensors 27 and various SWs 28 which are provided in the vicinity of the helm position together with the steering lever 1, are input through an input I/F 21.

A communications I/F 22 receives the communications information CI transmitted from another control unit through the communications network CN.

A CPU 25 includes an arithmetic processing unit for performing a predetermined arithmetic operation according to the signals and the information obtained through the input I/F 21 and the communications I/F 22, and outputting the result of the arithmetic operation. The CPU 25 includes a movement command value calculating section 25*a*, an output command value calculating section 25*b*, and another arithmetic processing section 25*c* for performing another arithmetic processing including collection processing of detection signals from various sensors, arithmetic processing for obtaining an engine control command, and transmission/reception processing of communications information.

The output I/F 23 outputs various output signals which are control signals CS obtained as a result of the arithmetic processing in the CPU 25 and received communications information, to various equipment including lamps and an indicator (both not shown) such as an LED which are provided in the vicinity of the helm position for displaying a control status of the outboard motor 9.

The communications I/F 24 transmits command signal information CI (CMS), which includes at least the output command value signal and the movement command value signal CMS thus calculated, and communications information CI, to another control unit through the communications network CN.

The engine control unit 7 has a structure similar to the above, as a control unit having a communications function in the CAN system. However, the engine control unit 7 does not relate to the features of the present invention, and therefore the illustration and the description thereof are omitted.

Hereinbelow, an operation to be performed by an operator to switch the movement of the boat to forward or to backward is described with reference to operation flowcharts of FIGS. 9 to 11. Those operation flowcharts are repeated at predetermined intervals decided in advance to attain desired control.

Figure 9:
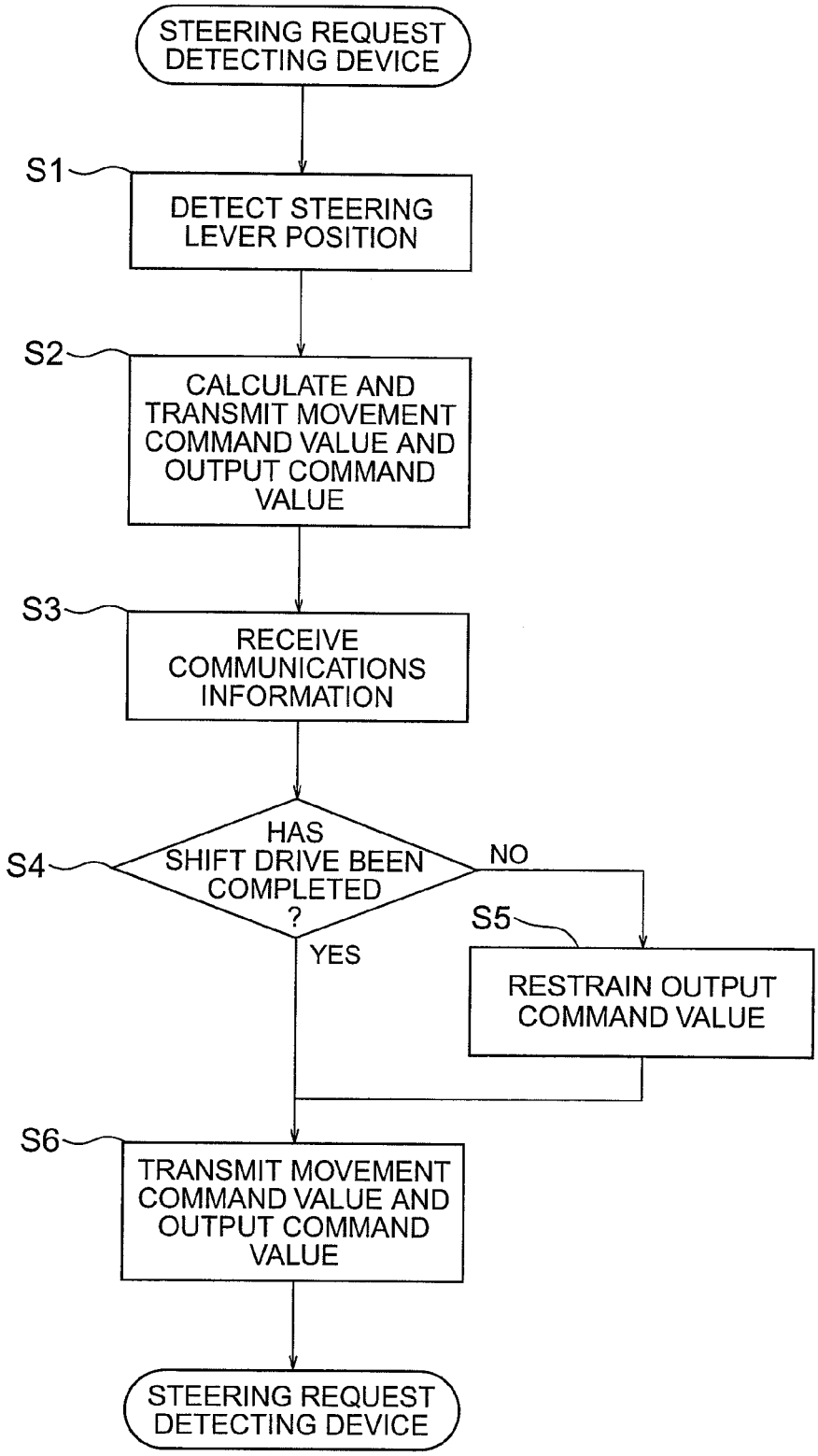
FIG. 9 is an operation flowchart illustrating an example of an operation of the steering request detecting device according to the present invention.

FIG. 9 is the operation flowchart illustrating an example of an operation of the steering request detecting device 2. First, when the position of the steering lever 1 has moved from a neutral position to a forward position or to a backward position, the steering request detecting device 2 detects an angular position of the steering lever 1 based on the sensor value signal from the operation angle sensor 1*a* (S1), calculates a movement command value and an output command value corresponding to the position of the steering lever 1, and transmits the movement command value and the output command value to each of the control units 5 and 3 as command signal information CI (CMS) (S2). In calculating the movement command value and the output command value, for example, the relation between the angular position of the steering lever 1, the movement command value, and the output command value as shown in FIG. 5 may be used, which may be stored in a built-in memory (not shown) of the CPU 25 as a table or an expression.

Next, the steering request detecting device 2 receives shift position information, which is the communications information CI from the shift actuator control unit 5, through the communications I/F 22 (S3). Then, in a case where the shift actuator 6 has reached a position of the movement command value, the steering request detecting device 2 determines that the shift drive has been completed (S4), and does not restrain the output command value calculated in the output command value calculation. In a case where the shift actuator 6 has not reached the movement command value, the steering request detecting device 2 restrains the output command value until the shift actuator 6 reaches the movement command value (S5). In this case, the restrained output command value corresponds to a value capable of controlling driving of the throttle actuator 4 (=throttle valve) to an aperture position close to total enclosure, or to an aperture position for driving an engine in an idling state.

Lastly, the movement command value and the output command value calculated are transmitted, as the communications information CI, to the shift actuator control unit 5 and the throttle actuator control unit 3 through the communications I/F 24 (S6).

Figure 10:
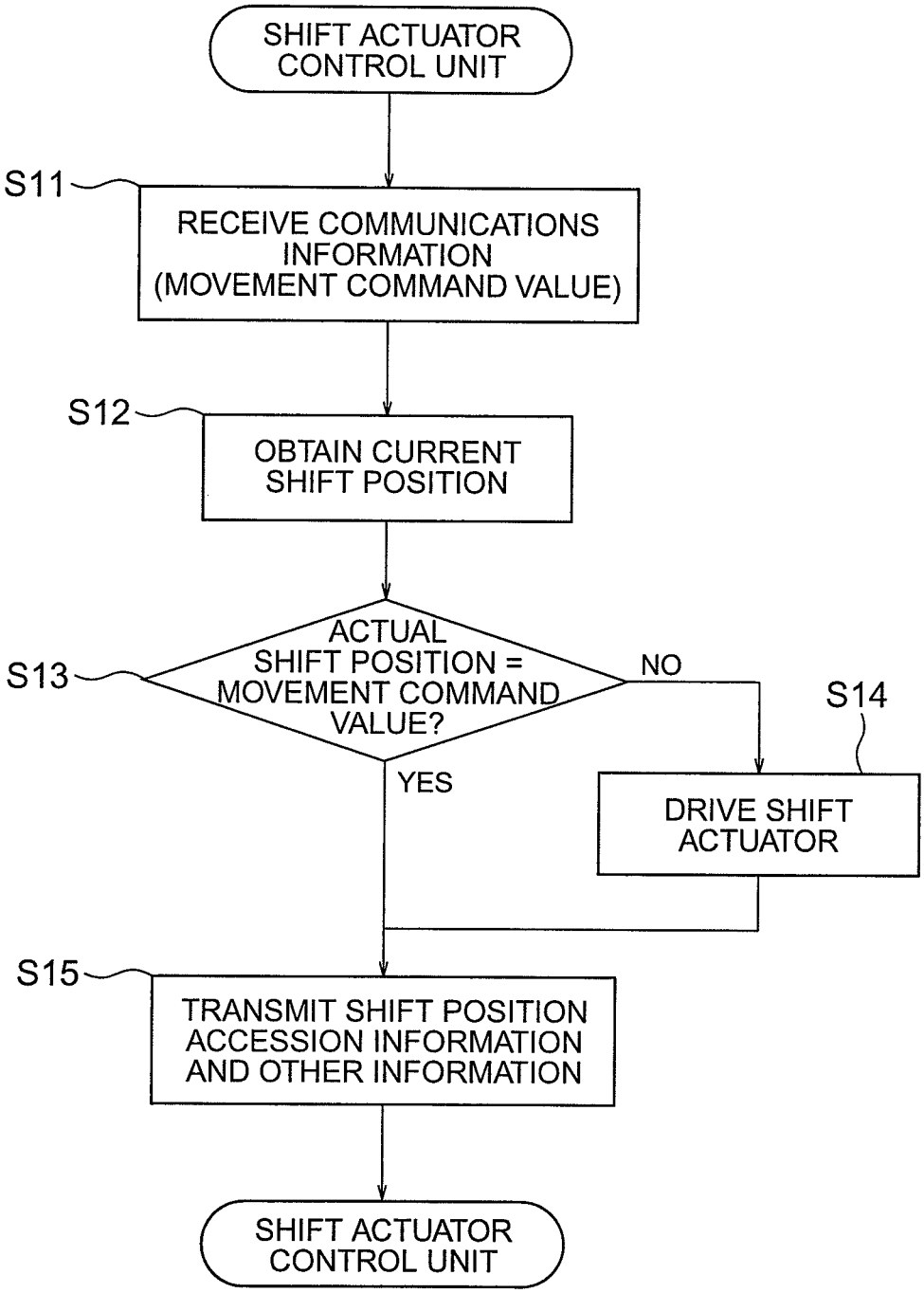
FIG. 10 is an operation flowchart illustrating an example of an operation of the shift actuator control unit according to the present invention.

FIG. 10 is the operation flowchart illustrating an example of an operation of the shift actuator control unit 5. The shift actuator control unit 5 receives the movement command value transmitted from the steering request detecting device 2, through the communications I/F 52 as the communications information CI (S11) Next, a current position of the shift actuator 6 is obtained as a shift position signal from the shift position sensor 56 (S12), and an actual shift position (current shift position) and the movement command value are compared with each other (S13). Then, a value of the shift drive signal CS is calculated such that the actual shift position coincides with the movement command value, and the shift drive signal CS thus obtained is transmitted to drive the shift actuator 6 (S14). When the shift actuator 6 has reached a target position indicated by the movement command value, information of the shift actuator 6 including shift position information indicating that the shift actuator 6 has reached the target position is transmitted as the communications information IC to the other control units including the steering request detecting device 2, through the communications I/F 54 (S15).

Figure 11:
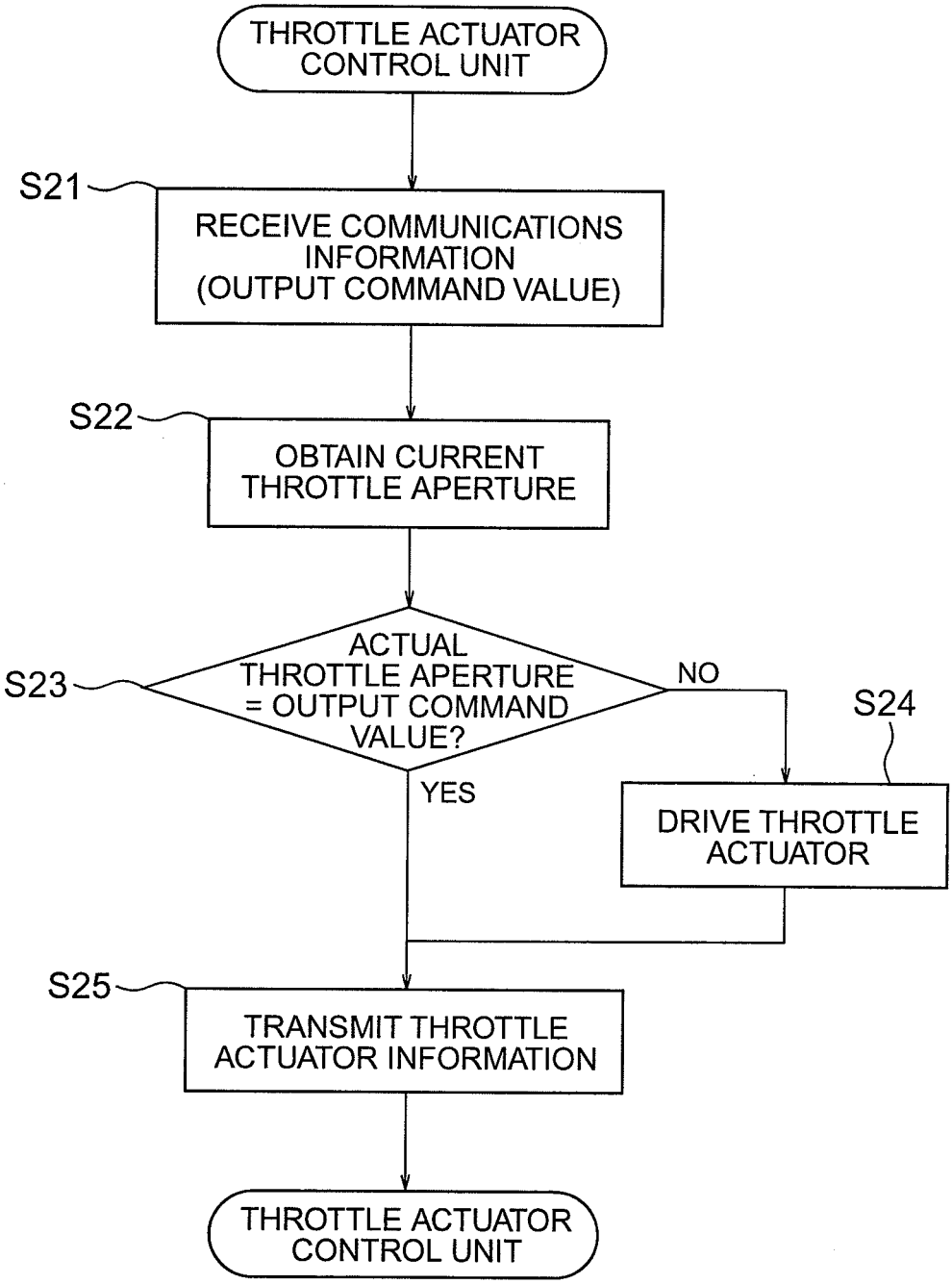
FIG. 11 is an operation flowchart illustrating an example of an operation of the throttle actuator control unit according to the present invention.

FIG. 11 is the operation flowchart illustrating an example of an operation of the throttle actuator control unit 3. The throttle actuator control unit 3 receives the output command value transmitted from the steering request detecting device 2, through the communications I/F 32 as the communications information CI (S21). Next, a current throttle aperture of the throttle actuator 3 is obtained as a throttle position signal from the throttle position sensor 36 (S22), and an actual throttle aperture (current throttle aperture) and the output command value are compared with each other (S23). Then, a value of the throttle drive signal CS is calculated such that the actual throttle aperture coincides with the output command value, and the throttle drive signal CS thus obtained is transmitted to drive the throttle actuator 4 (S24). When the throttle actuator 4 has reached a target aperture, information of the throttle actuator 4 including throttle position information indicating that the throttle actuator 4 has reached the target aperture is transmitted as the communications information IC to the other control units including the steering request detecting device 2, through the communications I/F 34 (S25)

Figure 12:
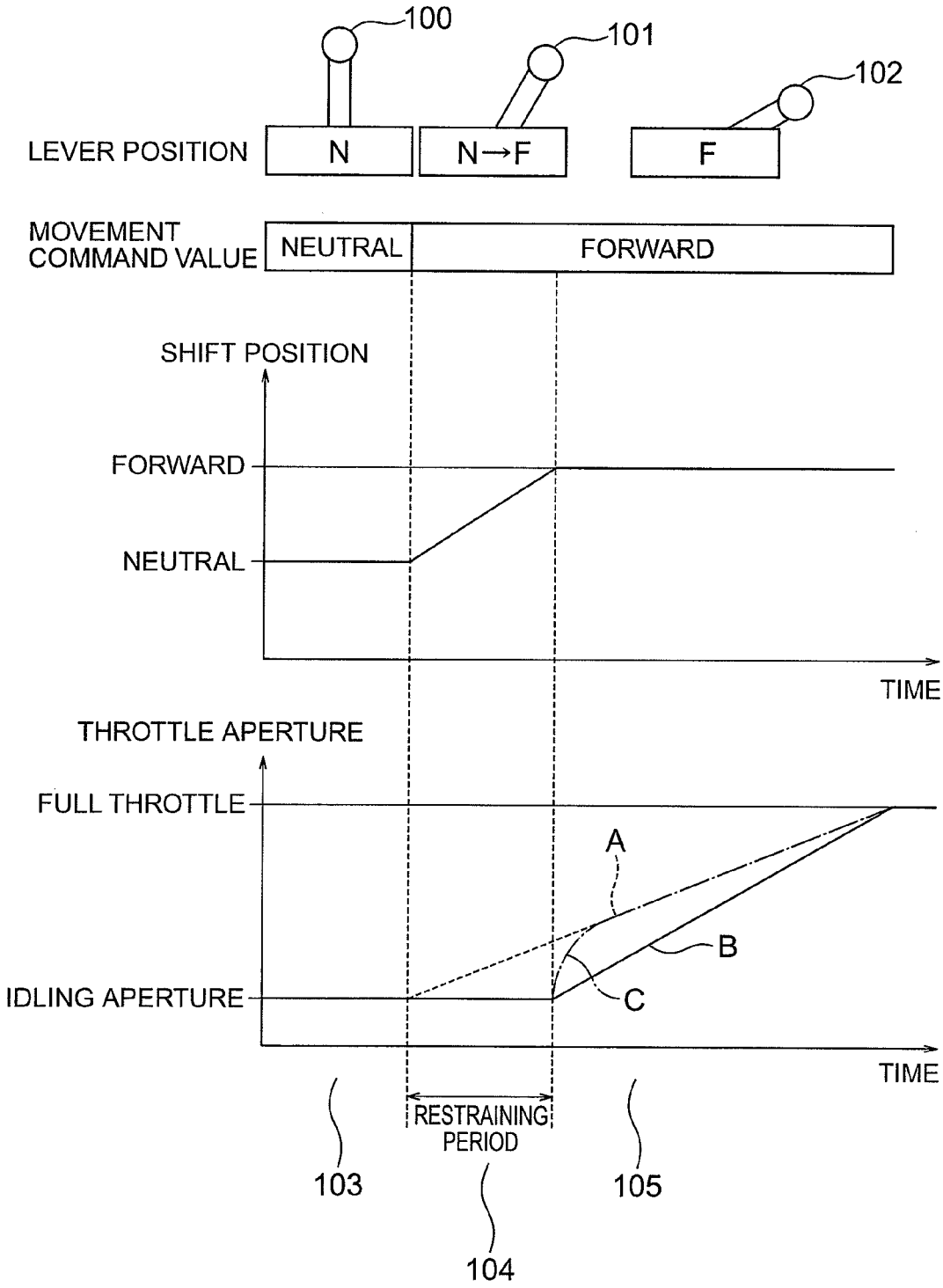
FIG. 12 is a timing chart for describing an operation of the electronic control apparatus for driving a boat according to the present invention.

FIG. 12 is a timing chart for describing an operation of the electronic control apparatus for driving a boat according to the present invention, in which the steering lever 1, the movement command value, the shift position of the shift actuator 6, and the throttle aperture of the throttle actuator 4 are associated with one another. FIG. 12 illustrates each of the statuses in which the steering lever 1 is operated by an operator to lever positions in the drawing.

When the operator has moved the steering lever 1 from a neutral state (100, 103) to a forward state (102, 105) via a neutral/forward intermediate range (101, 104), the movement command value transmitted by the steering request detecting device 2 immediately switches from the neutral state to the forward state as shown in the drawing.

However, it takes a predetermined period (104) to drive the shift position of the shift actuator 6 to the forward position by the shift actuator control unit 5 which has received the movement command value. During this period 104, the steering request detecting device 2 performs an operation to restrain the output command value with respect to the throttle actuator control unit 3 as described with reference to FIG. 9.

When the shift actuator 6 has reached the movement command value, the steering request detecting device 2 withdraws the restraint on the output command value, and transmits the output command value which has been unchanged after calculated, to the throttle actuator control unit 3. Accordingly, the throttle aperture is increased after the shift of the shift actuator 6 is completed as shown by the solid line B of FIG. 12, as compared with a case shown by the dashed line A of FIG. 12 in which the output command value is not restrained.

In the above-mentioned example, the steering request detecting device 2 first restrains the output command value, and then transmits the output command value which increases at a rate (constant increase rate) larger than a conventional increase rate. However, the steering request detecting device 2 may transmit the output command value which increases at the conventional increase rate, after restraining the output command value.

Alternatively, as shown by the dashed-dotted line C of FIG. 12, the throttle actuator control unit 3 may perform feedback control such as proportional, integral, differential (PID) control, such that the throttle aperture, that is, the output command value to be transmitted to the throttle actuator control unit 3 reaches close to the output command value of original target value in a short time.

As described above, in the electronic control apparatus for driving a boat according to the present invention which adopts the above-mentioned method, the throttle actuator is driven only after the shift actuator has reached the movement command value, which makes it possible to surely switch the shift position of the boat without reducing the resolution powers of the output command value and the movement command value calculated based on the position of the steering lever or giving damage to the shift mechanism of the transmission of the boat.

In the above-mentioned embodiment, the shift actuator control unit 5 transmits, with respect to the steering request detecting device 2, shift position information indicating whether or not the shift actuator has reached the movement command value, as the communications information CI. However, the present invention may also be structured such that the shift actuator control unit 5 constantly transmits a current shift position of the shift actuator 6 as the communications information CI, and the steering request detecting device 2 may compare, in Step S4 of FIG. 9, the movement command value of the shift actuator 6 and a current position of the shift actuator 6 transmitted from the shift actuator control unit 5 so as to determine whether the shift drive has been completed.

Also, the above-mentioned embodiment has been described with reference to an exemplary case where the shift actuator control unit 5 and the throttle actuator control unit 3 are structured independently of each other as shown in FIG. 4. However, those control units 5 and 3 may be integrally formed into one block, and the block transmits the throttle drive signal and the shift derive signal to the throttle actuator 4 and the shift actuator 6, respectively, while receiving the position signal from each of the throttle position sensor 36 and the shift position sensor 56. With this structure, the same effect can be produced while downsizing and simplifying the device.

Further, in the above-mentioned embodiment, a boat having an outboard motor has been described. However, the present invention is applicable to a boat of inboard type which incorporates an engine in the boat body, to produce the same effect.

What is claimed is:

1. An electronic control apparatus for driving a boat, comprising:

a steering mechanism having one steering lever operated by an operator to control both driving the boat forward or backward, and an engine output;

a shift actuator for switching a transmission of an engine of a boat among neutral, forward, and backward;

a shift position sensor for detecting neutral, forward, and backward positions and intermediate ranges thereof of the shift actuator:

a throttle actuator for driving a throttle valve to regulate an engine output;

an electronic control unit connected to each of the steering mechanism, the shift actuator, and the throttle actuator, for calculating a movement command value for controlling shift position of the shift actuator and an output command value for controlling a throttle aperture of the throttle actuator, respectively, based on a steering position signal from the steering mechanism, and for controlling the shift actuator and the throttle actuator respectively according to the movement command value, the output command value, and a feedback signal indicating a control state of the shift actuator, and the output command value and a feedback signal indicating a control state of the throttle actuator, respectively, and the electronic control unit configured to restrain the output command value until a shift operation of the shift actuator is completed, in a case where the movement command value has been generated for shifting the shift actuator to one of forward and backward, and after a completion of the shift operation, the output command value is controlled so as to substantially reach an originally targeted output command value, wherein, in an instance where the movement command value being generated for shifting the shift actuator to one of forward and backward, wherein an actual shift position obtained from the shift position sensor does not coincide with the movement command value, the electronic control unit restrains the output command value, until the shift actuator completes a shift operation thereof, to a value which corresponds to a value capable of controlling driving of the throttle actuator to a throttle position close to total close or to a throttle position for an idling state, and wherein the actual shift position coincides with the movement command value, in order to coincide an increase rate of the output command value with an intended increase rate of an operator at the output command value generation in a short amount of time, the short amount of time being that the electronic control unit increases the increase rate of the output command value once at an initial stage after the coincidence of the actual shift position and the movement command value and then decreases the increase rate gradually to coincide with the indented increase rate.

2. The electronic control apparatus for driving a boat according to claim 1, wherein, when the output command value is restrained, the output command value corresponds to one of an aperture position of the throttle actuator close to total enclosure and an aperture position for driving an engine in an idling state.

3. The electronic control apparatus for driving a boat according to claim 1, wherein the electronic control unit comprises:

a steering mechanism control unit connected to the steering mechanism, for calculating the movement command value with respect to the shift actuator and the output command value with respect to the throttle actuator, based on the steering position signal;

a shift actuator control unit connected to the shift actuator, for controlling the shift actuator according to the movement command value calculated and the feedback signal indicating a control state of the shift actuator;

a throttle actuator control unit connected to the throttle actuator, for controlling the throttle actuator according to the output command value calculated and the feedback signal indicating a control state of the throttle actuator; and a communications section for communicably connecting the steering mechanism control unit, the shift actuator control unit, and the throttle actuator control unit with one another.

4. The electronic control apparatus for driving a boat according to claim 2, wherein the electronic control unit comprises:

a steering mechanism control unit connected to the steering mechanism, for calculating the movement command value with respect to the shift actuator and the output command value with respect to the throttle actuator, based on the steering position signal;

a shift actuator control unit connected to the shift actuator, for controlling the shift actuator according to the movement command value calculated and the feedback signal indicating a control state of the shift actuator;

a throttle actuator control unit connected to the throttle actuator, for controlling the throttle actuator according to the output command value calculated and the feedback signal indicating a control state of the throttle actuator; and a communications section for communicably connecting the steering mechanism control unit, the shift actuator control unit, and the throttle actuator control unit with one another.

5. The electronic control apparatus for driving a boat according to claim 3, wherein the shift actuator control unit and the throttle actuator control unit are formed into one control unit.

6. The electronic control apparatus for driving a boat according to claim 4, wherein the shift actuator control unit and the throttle actuator control unit are formed into one control unit.

7. The electronic control apparatus for driving a boat according to claim 3, wherein:

the shift actuator control unit transmits the feedback signal indicating a control state of the shift actuator to the steering mechanism control unit; and the steering mechanism control unit compares the movement command value and the feedback signal with each other.

8. The electronic control apparatus for driving a boat according to claim 4, wherein:

the shift actuator control unit transmits the feedback signal indicating a control state of the shift actuator to the steering mechanism control unit; and the steering mechanism control unit compares the movement command value and the feedback signal with each other.

9. The electronic control apparatus for driving a boat according to claim 3, wherein the communications section comprises a CAN.

10. The electronic control apparatus for driving a boat according to claim 4, wherein the communications section comprises a CAN.

11. The electronic control apparatus for driving a boat according to claim 5, wherein the communications section comprises a CAN.

12. The electronic control apparatus for driving a boat according to claim 6, wherein the communications section comprises a CAN.

13. The electronic control apparatus for driving a boat according to claim 7, wherein the communications section comprises a CAN.

14. The electronic control apparatus for driving a boat according to claim 8, wherein the communications section comprises a CAN.

15. The electronic control apparatus for driving a boat according to anyone of claims 1 to 14, wherein:

the electronic control apparatus for driving a boat is applied to a boat having an outboard motor; and the outboard motor is provided with the engine, the shift actuator, and the throttle actuator.

* * * * *